United States Patent [19]

Kovacik et al.

[11] 4,287,456

[45] Sep. 1, 1981

[54] PORTABLE FLUORESCENT TUBE ASSEMBLY HAVING LOW VOLTAGE CONVENIENCE OUTLET

[75] Inventors: James W. Kovacik; James D. Kovacik, both of Parma; Thomas J. Blanch, Aurora; Paul S. Blanch, Garfield Heights, all of Ohio

[73] Assignee: Alert Safety Lite Products Company, Bedford Heights, Ohio

[21] Appl. No.: 100,998

[22] Filed: Dec. 6, 1979

[51] Int. Cl.[3] ..... H05B 41/18

[52] U.S. Cl. ..... 315/283; 315/288; 315/290; 315/326; 315/DIG. 5; 339/50 R; 362/221

[58] Field of Search ..... 315/246, 283, 288, 289, 315/291, 326, 290, 163, 182, 250, DIG. 5; 362/217, 220–222, 416, 95, 225; 339/50 R, 51, 119 L, 278 L

[56] References Cited

U.S. PATENT DOCUMENTS

| | | | |
|---|---|---|---|
| 2,314,233 | 3/1943 | McSween | 200/51 R |
| 2,318,057 | 5/1943 | Cohen | 200/5 F |
| 2,331,040 | 10/1943 | Naster | 200/5 F |
| 2,678,380 | 5/1954 | Westby | 362/220 |
| 3,331,958 | 7/1967 | Adler | 315/209 R |
| 3,604,920 | 9/1971 | Niles | 315/100 X |
| 3,815,080 | 6/1974 | Summa | 339/52 R |
| 3,860,829 | 1/1975 | Fabbri | 307/66 |
| 3,989,335 | 11/1976 | Belokin, Jr. | 339/50 R |

FOREIGN PATENT DOCUMENTS

| | | | |
|---|---|---|---|
| 1141186 | 3/1957 | France | 362/221 |

*Primary Examiner*—Eugene R. La Roche

*Attorney, Agent, or Firm*—Wilson, Fraser, Barker & Clemens

[57] ABSTRACT

A portable fluorescent tube assembly is disclosed having a relatively low voltage electric convenience outlet associated with the assembly. Although higher than normally supplied voltages are needed to initiate the lighting of a fluorescent tube, these voltages are unsuited for energizing still other electrical apparatus which is designed for normally supplied voltages. The circuitry of the present fluorescent tube assembly supplies both relatively high and low voltages at the portable unit itself, so that the tube can be fired to initiate lighting at the relatively high voltage, and yet other electrical apparatus can be energized directly from the portable assembly at a relatively low voltage.

12 Claims, 13 Drawing Figures

PORTABLE FLUORESCENT TUBE ASSEMBLY HAVING LOW VOLTAGE CONVENIENCE OUTLET

CROSS-REFERENCE TO RELATED CASE

A portable fluorescent tube assembly having many of the structural features disclosed herein is described and claimed in a copending application, filed Aug. 7, 1979, and assigned Ser. No. 064,490.

BACKGROUND OF THE INVENTION

The present invention relates to a fluorescent tube assembly and particularly one which is portable and can be manually moved about and suspended at a work site to aid a user in obtaining the best lighting conditions. It has been the practice to use incandescent light bulbs, suitably encased in light guards, for this purpose. Such lights are often referred to as trouble lamps, extension lights, work lights, inspection lights, and the like, and are commonly employed by mechanics and other workers who require a concentration of light in a frequently changing location.

Fluorescent lights have several advantages over incandescent bulbs. As an example, for the same wattage, fluorescent lights usually provide more light with less glare. U.S. Pat. No. 3,953,761 to Lo Giudice reports that a fluorescent light tube consumes approximately one-sixth of the energy or electrical current required by an incandescent bulb to produce the same amount of light output. Thus, particularly in the present time of energy crisis, substantial energy savings can be effected by the use of fluorescent light tubes instead of incandescent bulbs. Moreover, the same patent mentions that fluorescent light tubes have a life expectancy which is up to 10 times longer than that of conventional incandescent light bulbs.

While it has been suggested to provide extension lights using the usual incandescent bulbs at normally supplied voltages, such as 110 volts to 120 volts, with an electrical outlet, as illustrated in U.S. Pat. No. 2,653,219 to Popp, this has not occurred to applicant's knowledge with fluorescent tube assemblies and especially with those designed for portable use. One reason for this disparity is that fluorescent tubes require different circuitry supplying higher voltages than voltages normally supplied at wall outlets and the like.

Fluorescent tubes or lamps ordinarily comprise an elongated glass bulb having mercury vapor, sodium vapor, or still other gases which produce ultraviolet light when electrically excited. This light may also cause phosphors, if present on the inside of the tube, to luminesce. The tube has terminals at each end, usually in the form of a pair of protruding pins.

To start or fire a fluorescent tube, a higher voltage is required than that needed to maintain the tube in a lighted condition once the initial higher voltage barrier is overcome. For this purpose, a fluorescent tube has electric starter means within each end of the tube, often in the form of fine tungsten filaments. To fire the tube, the starting filaments may be heated by a relatively high voltage until an arc or discharge is struck between the two heated filaments. This requires a flow of high voltage current through the filaments before the arc or discharge is struck and the lamp begins its illumination, or until the gas in the tube ionizes to conduct a current through the tube. Thereafter, a relatively low voltage may be used to maintain the tube in a lighted condition.

A ballast, sometimes referred to as a coil or choke coil, is commonly used in a circuit for a fluorescent tube to obtain the higher voltage needed to fire it. The ballast is essentially a transformer. The presence of such relatively high voltage in a unit has made it hazardous to operating personnel to incorporate in the tube assembly still other electric features such as convenience outlets. The higher voltage present can increase the likelihood of electric short circuits to other parts of the circuit such as to electric outlets. This has discouraged the adaptability of fluorescent tube assemblies and especially the portability of such assemblies where the presence of additional convenience outlets would be most useful.

SUMMARY OF THE INVENTION

An object of the present invention is to provide a fluorescent tube assembly that has an electric convenience outlet safely associated with the assembly in spite of the presence of a relatively high voltage circuitry needed to fire the tube. Another object is to provide a portable fluorescent tube assembly that can be carried from place-to-place to a work site and which contains its own convenience outlet to which other electrical apparatus, operated at relatively low voltage, can be directly connected and thereby eliminate the need for additional electric outlets of more standard voltage at the work site. A further object is to provide electric circuitry for a fluorescent tube assembly which makes a convenience outlet of lower, normal voltage safely possible. A still further object is to provide a strong and durable, self-contained portable fluorescent tube assembly that is simple in design and economic in construction.

In one form, the fluorescent tube assembly comprises a fluorescent tube encased within a light-transmitting envelope and socket members for each end of the tube. The socket members provide for electric connection to terminals of the tube including electric starting means within each end of the tube.

The assembly contains an electric convenience outlet adapted to energize other electric apparatus at a first voltage and starter switch means for firing the fluorescent tube adapted to operate at a second and higher voltage. Circuitry for the assembly includes a pair of electric conductors adapted to be connected to a source of electric energy supplied at the first lower voltage. One of the conductors is connected in series to the convenience outlet, the electric starting means of the tube and the starter switch means. The other of the two electric conductors is connected to the convenience electric outlet to supply an electric voltage or potential to the convenience outlet at the first lower voltage. The other electric conductor is also connected in parallel through ballast means to the starter switch means to supply an electric potential at another and higher voltage which is adapted to fire and operate the fluorescent tube.

In one embodiment, the fluorescent tube assembly is a portable and the starter switch means and convenience outlet are located on the portable assembly. In another embodiment the ballast means is located adjacent to the free end of its conductor to relieve the assembly of weight of the ballast means. In a preferred embodiment, the fluorescent tube assembly includes a handle for easy transportation of the assembly, the handle containing the electric convenience outlet and the starter switch means.

DESCRIPTION OF THE PREFERRED EMBODIMENT

Figure 1:
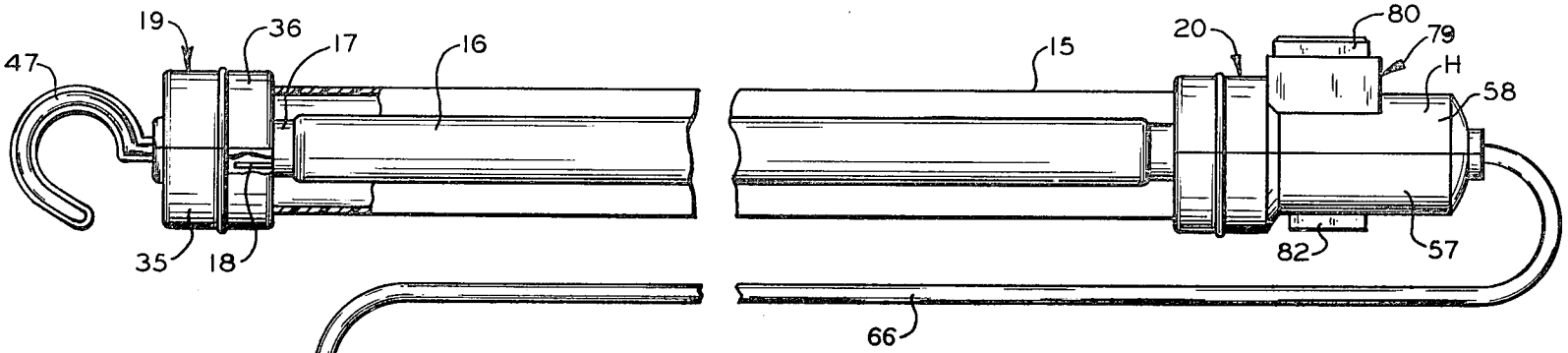
FIG. 1 is a side elevational view, partially in section, of a portable fluorescent tube assembly which may have a circuit of the present invention.

The present circuitry, designed to provide both relatively high and relatively low voltages at the tube assembly itself, may take various forms within the scope of the following disclosure. Similarly, the fluorescent tube and attendant parts may differ widely in physical construction and mounting.

However, the form and construction of one fluorescent tube assembly, representing at present the best mode of utilizing the present circuitry, is described in detail to disclose the invention. This is followed by a description of one form of circuitry which may be used to energize the described tube assembly.

As used here and in the claims, the term "relatively low voltage" means a voltage normally found in standard outlets, for example from about 110 volts to about 120 volts; and the term "relatively high voltage" means a higher voltage approximating that needed to operate the electric starting means of a fluorescent tube and initiate or fire the lighting of the tube.

In general, the illustrated fluorescent tube assembly includes a light-transmitting envelope concentrically containing a standard fluorescent tube. At each end, a socket construction joins the envelope and tube and holds the assembly together. The socket also contains electrical leads or conductors for energizing the tube. To this end, one socket structure is enlarged to house starter switch means and at least one electric convenience outlet and to receive incoming electric conductors. The free or opposite ends of the electric conductors may terminate in an integral unit containing both an electrical plug for connection to a source of electrical energy and ballast means for the fluorescent tube.

Referring to these parts in greater detail, and initially to FIGS. 1 and 3 through 8, the illustrated embodiment includes an outer tubular envelope 15 concentrically disposed about a standard glass fluorescent tube 16. Envelope 15 is preferably fabricated from a heat resistant synthetic plastic as are many of the hereinafter defined parts. Tube 16 has metal ferrules 17 at each end from which extend a pair of electro-conducting contact pins 18. Tube 16 can vary as to length and wattage but, for example, may vary between about 12 inches and about 18 inches and be rated at about 8 watts or 15 watts.

Envelope 15 extends beyond each end of tube 16. A cooperating pair of end sockets, generally indicated at 19 and 20, fit about the envelope extensions and hold the envelope and tube together as well as house electric circuitry for the tube. As illustrated by FIGS. 3 through 8, a plastic support body 21 fits within the tubular extensions of envelope 15 which passes beyond the end of tube 16 and is adapted to effect electrical connection with pins 18 of the tube as well as aid in holding together the end components of the fluorescent tube assembly.

More particularly, support body 21 comprises a ring 22 having radially projecting fingers 23 which are of a length to reach and contact the inner surface of envelope 15 and thereby position body 21 centrally with respect to the envelope. Fingers 23 also act as shock-absorbers when the tube assembly receives mechanical shock and reduces the likelihood of breakage or other damage to the tube assembly. A diametral section 25 extends across ring 22 and has a pair of substantially parallel passages 26 in which metal, pin-gripping sleeves 27 (FIG. 8) are inserted and held in position by reduced portions 28 of passages 26.

Figure 3:
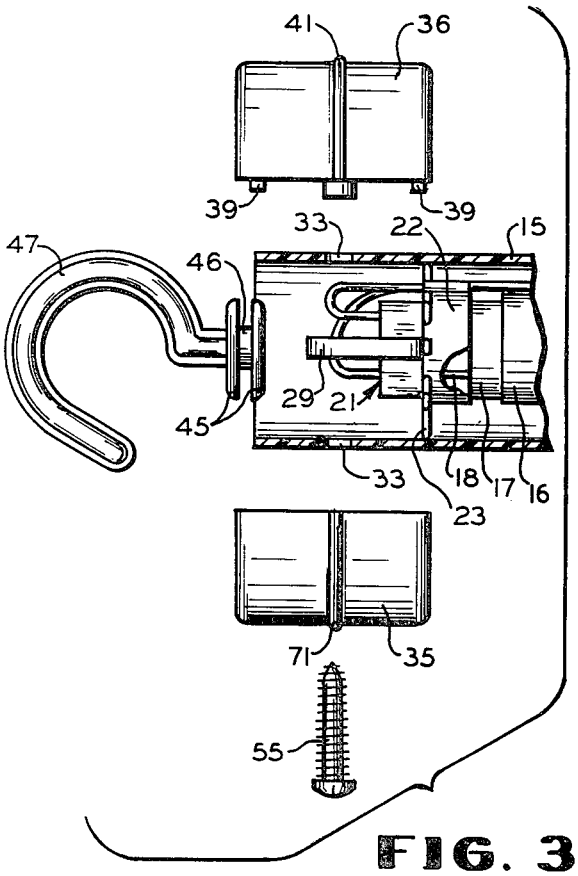
FIG. 3 is an exploded view, partly in section, of the left hand socket construction of the tube assembly of FIG. 1.

A ledge 29 extends rearwardly of support body 21 and has a transverse opening 30. At one side, body 21 has an enlargement 31 provided with a through passage 37. In use, pins 18 from tube 16 are inserted in the metal sleeves 27 contained in passages 26 of support body 21. Electric conductors reaching from the other end of the tubular assembly, as hereinafter more fully described, extend through passage 32 of enlargement 31 and make electrical connection with pins 18 on that side of body 21 having ledge 29, as illustrated in FIG. 3.

End socket 19 includes a pair of plastic mating caps or cup-shaped socket members 35 and 36. Each socket member is semi-circular to preserve the circular configuration of the assembly and has a flat, rectangular face which seats against the other face when the socket members enclose envelope 15. Socket members 35 and 36 have mating portions to aid in meeting and registering the socket members with one another along the faces. In the illustrated embodiment, cup-shaped member 36 has a projecting pin 39 at each corner of its face, while cup-shaped member 35 has a matching recess at each corner of its face to receive the pins 39.

Each socket member 35 and 36 has a circumferentially extending reinforcing rib 41 and together form matching end bores. Bore 42 is larger and of a size to fit tightly around the outside of envelope 15. Bore 43 is much smaller and of a size to fit between flanges 45 on a stem 46 of a plastic hook 47 and thereby lock the hook to the assembly. By means of hook 47, the assembly may be suspended at a desired location such as a work site. Bore 43 is sufficiently oversized to permit stem 46 of hook 47 to turn 360° about an axis defined by stem 46, so that the assembly can be conveniently rotatably positioned with respect to the hook 47 which remains in a stationary position.

Figure 4:
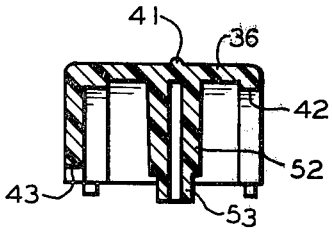
FIG. 4 is a section taken in the plane of the sheet of drawing of the upper socket member of FIG. 3.
Figure 5:
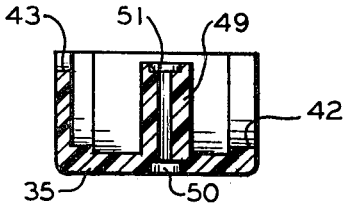
FIG. 5 is a section taken in the plane of the sheet of the drawing of the lower socket member of FIG. 3.
Figure 6:
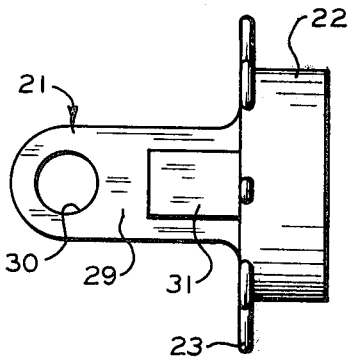
FIG. 6 is a top plan view of a support body of the end socket construction of FIG. 3.
Figure 7:
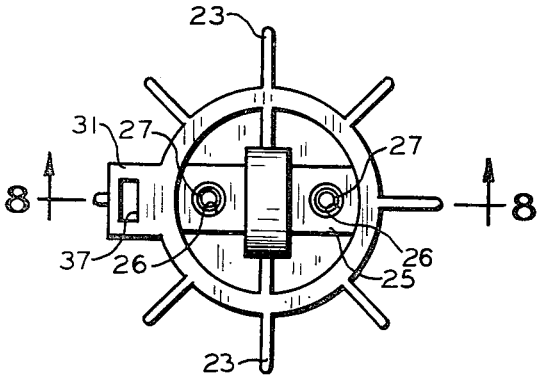
FIG. 7 is a right hand end view of FIG. 6.
Figure 8:
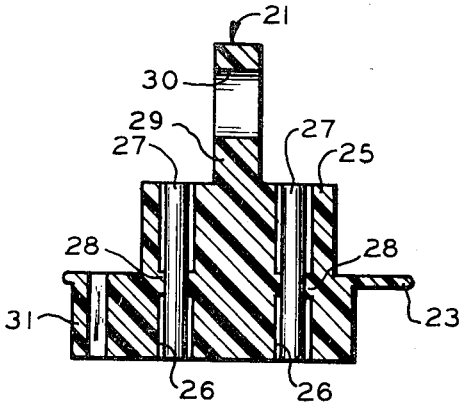
FIG. 8 is a section of FIG. 7 on the line 8—8 and illustrates the presence of metal sleeves which grip electroconducting pins of a fluorescent tube.

An important function of the cup-shaped socket members 35 and 36 of end socket 19 is to hold the described parts in assembly. To this purpose, each member has a connecting section which is aligned with a connecting section of the other member. Preferably, the connecting sections meet or abut. At least one of the connecting sections passes through the aperture of ledge 29 to couple and fix support body 21 with the socket members as well. As shown in FIGS. 4 and 5, socket member 35 has a tubular post 49 aligned with an outside opening 50 in that member. The end of post 49 is recessed as at 51. Socket member 36 has an internal tubular post 52 having a narrowed tip 53. The two posts are axially aligned so that when socket members 35 and 36 embrace about envelope 15 and meet face to face, the tip 53 of post 52 enters the recess 51 of post 49. This union takes place with either the two posts passing through aperture 30 and then joining the other post. Envelope 15 has opposed openings 33 to pass posts 49 and 52. A self-tapping fastener 55 passes through opening 50 in socket member 35 and the interior of tubular post 49 and threadably engages the interior of post 52 to secure all parts, including hook 47, in assembly.

The physical mounting and electrical connections to pins of tube 16 within end socket 20 at the opposite end of the assembly is the same as that described for the pins of the tube for end socket 19. Thus a support body 21*a* is identical in all respects to the support body 21 illustrated by FIGS. 3, 6, 7 and 8. Support body 21*a* similarly has passages to receive pins 18 of tube 16, fingers 23*a* which resiliently engage envelope 15, and a rearward ledge 29*a* having a transverse aperture to aid in holding the parts in assembly, all as described for end socket 19. Where parts of support body 21*a* are illustrated corresponding to parts of support body 21, they are given the same reference number with the additional suffix "a".

End socket 20 also performs functions similar to those of end socket 19 but is enlarged in a lengthwise direction to define a handle. The handle accommodates starter switch means for the tube and incoming electric conductors together with the electric connections involved. Socket 20 includes a pair of mating, plastic socket members 57 and 58. Each socket member is semicircular and has a flat, rectangular face, which seats against the other when the socket members enclose this end of the fluorescent tube assembly. For this purpose, the face of socket member 58 has projecting pins 61 which seat within recesses correspondingly positioned on the face of socket member 57.

Figure 10:
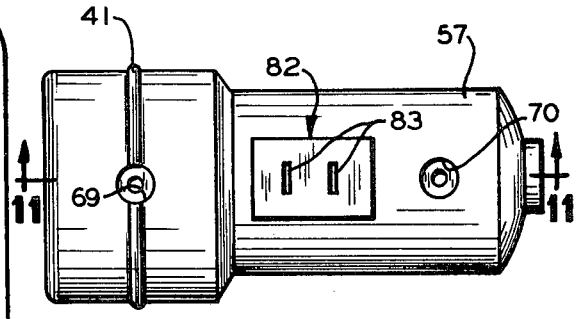
FIG. 10 is a section of FIG. 9 on the plane of the line 10—10 and shows an electric convenience outlet.
Figure 11:
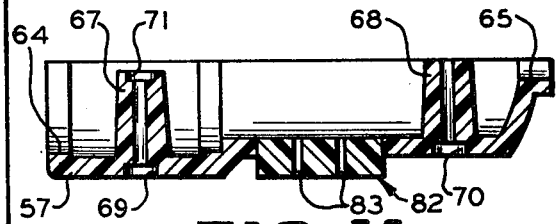
FIG. 11 is a section of FIG. 10 on the line 11—11.
Figure 12:
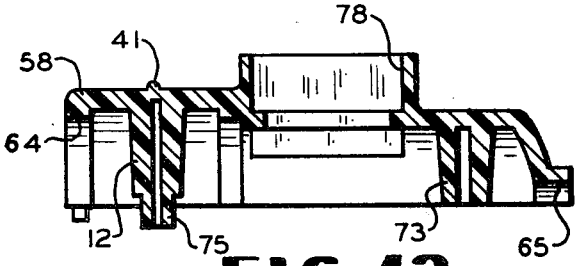
FIG. 12 is a section taken in the plane of the sheet of drawing of the upper socket member of FIG. 9.

As shown especially by FIGS. 10, 11 and 12, each plastic socket member 57 and 58 has a left-hand portion (as viewed in those figures) corresponding to socket members 35 and 36 of end socket 20, and a right-hand portion representing an enlargement to house other components. A bore 64 formed by the mating socket members is of a size to fit tightly around the outside of envelope 15. A bore 65 similarly formed at the other end of end socket 20 is smaller and of a size to receive incoming electrical conductors 66.

Socket members 57 and 58 have reinforcing ribs 41 and connecting sections which meet to secure together that end of the assembly. Socket member 57 has a pair of tubular posts 67 and 68, each of which is aligned with an outside opening 69 and 70, respectively. The end of post 67 is recessed as at 71. Socket members 58 similarly has a pair of tubular posts 72 and 73, post 72 having a narrowed tip 75. Posts 67 and 68 are axially aligned with posts 72 and 73, respectively, so that when members 57 and 58 embrace about envelope 15 and meet face-to-face, the narrowed tip 75 of post 72 enters the recess 71 of post 67. Post 68 and 73 abut against each other. The union of posts 67 and 68 takes place with at least one of the posts passing through the aperture of ledge 29*a* of the support body 21*a*, or the posts 67 and 72 meet within such aperture. Envelope 15 has opposed openings 74 to pass posts 67 and 72. Self-tapping screws 76 pass through the outside openings 69 and 70 and the interiors of posts 67 and 68 while threadably engaging the opposed posts 72 and 73 to hold the parts of end socket 20 together.

As indicated the lengthwise extensions of socket members 57 and 58 define a handle H (FIG. 1) by which the fluorescent tube assembly can be conveniently handled and carried about and placed, as by hook 47, at a desired location. The lengthwise extension of socket member 58 also has a rectangular opening 78 in which a four pole, push button, starter switch, generally indicated at 79, makes a snap fit and can be easily operated as desired from handle H. Switch 79 has a depressible button 80 and electrical leads 81*a* and 81*b* connected to terminals on the switch. The switch is of conventional construction normally used to start or extinguish the light of a fluorescent tube. As an example, a switch commercially available and designated Leviton No. 3382 can be used for this purpose. Leads 81*a* and their terminals define a primary circuit for switch 79 and leads 81*b* and their terminals define a secondary circuit.

In truly convenient fashion, socket member 57 contains an electric convenience outlet generally represented at 82. Outlet 82 is located midway of the semicircular outer surface of socket member 57 and, when socket members 57 and 58 are assembled, about 180° away from starter switch 79. Convenience outlet 82 is a standard female electric connector having a pair of spaced openings 83 to receive mating prongs of a standard male electric connector.

Figure 9:
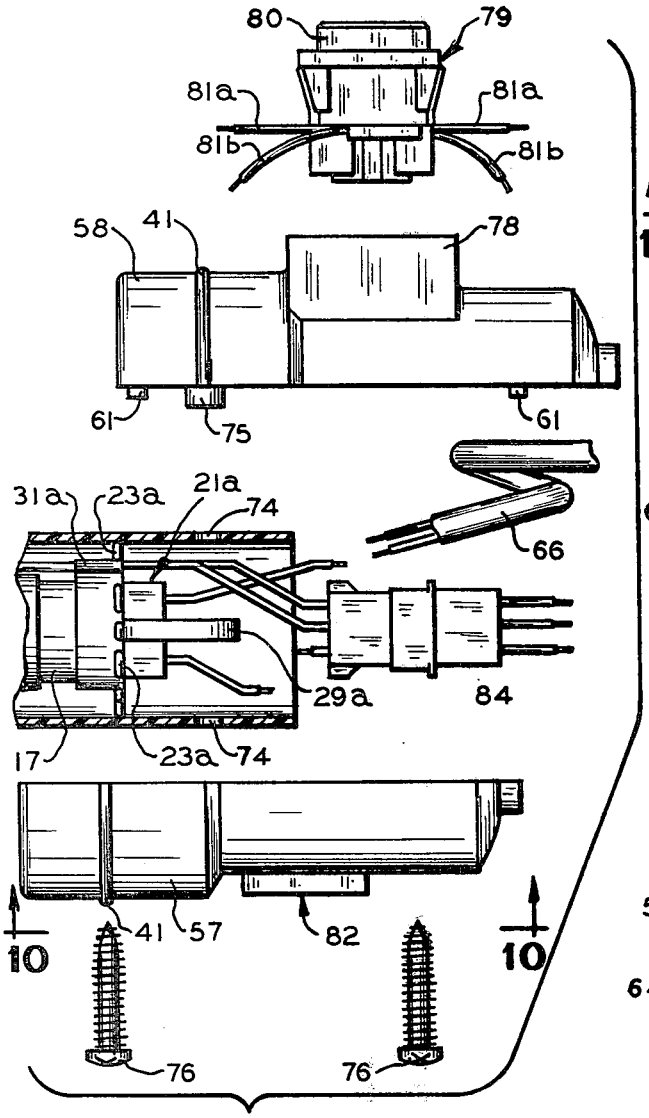
FIG. 9 is an exploded view, partially in section, of the right hand socket construction of the tube assembly of FIG. 1.

The lengthwise addition to end socket 20 as compared to end socket 19 also houses incoming electric connectors and their electrical connections to switch 79, tube 16, and electric convenience outlet 82. Reference is made to the circuit diagram of FIG. 2 for description of how the circuit is connected to and includes these parts. In the exploded view of FIG. 9, a connector box 84 is shown which may be used to facilitate such connections. Box 84 is a standard two-part connector of a number, illustrated as three in FIG. 9 of male and female electric jack connections, the two parts telescoping together and effecting union of the multiple jack connections. Such connector boxes are conventional and commercially available. One is sold under the trademark "Mate-N-Lok". As shown in FIG. 9, electric conductors from connector box 84 pass through an opening in side enlargement 31*a* of support body 21*a* and extend along the assembly between envelope 15 and tube 16 to end socket 19 and make connection with pins 18 of tube 16 at that end as shown by FIG. 3.

Figure 13:
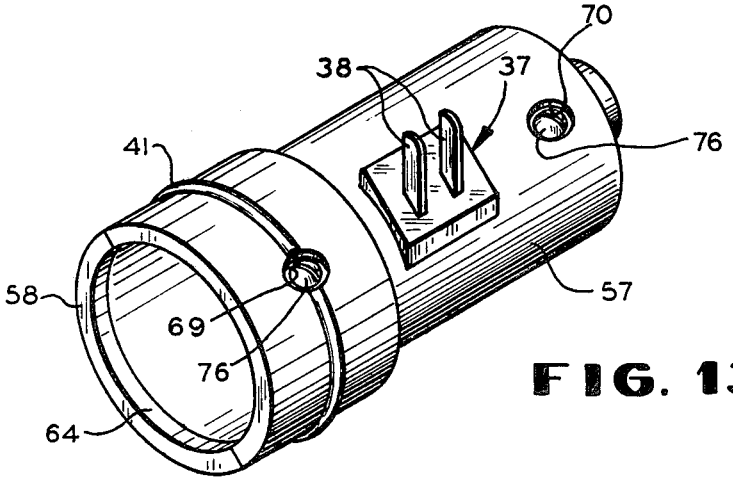
FIG. 13 is a perspective view of a male electric connection which may be used in place of the female electric connection of FIGS. 9 and 10.

It will be understood that the electric convenience outlet need not be a female tap-in or connector but can of any type including switch means. FIG. 13 illustrates a male connector which may be optionally used. The connector, generally represented at 37, may be of a conventional type having spaced-apart prongs 38 adapted for mating with a matching outlet of an electric apparatus. In this embodiment a guard or cover (not shown) may be detachably secured about prongs 38 when the outlet is not in use to avoid electric shocks from the exposed prongs.

Ballast means for tube 16 may be included in one of the leads or connectors 66. In the illustrated embodiment, ballast means is connected to the circuit at a relatively distant point from the fluorescent tube assembly to relieve it of bearing the weight of the comparatively heavy ballast. Similarly, the ballast and inlet plug by which the entire assembly is electrically energized may be physically spaced apart in the circuit, but preferably both the ballast and the electrical plug are contained in one integral unit as shown, partly in section, in FIG. 1. This unit, generally represented at 85, includes an open core transformer 86 having L-shaped legs 87 which are secured to a mounting plate 88 by rivets 89. A four sided cover 91 fits about the transformer and is suitably secured to base 88. Electric conductors 66 enter unit 85 through a boss 93 on the cover. When assembled, a plug 94 is recessed within cover 91 and behind plate 88 so that only its prongs, including ground prong 92, project therefrom for insertion into a source of electrical energy.

Starter switch 79 is of the type known in the art having a dual action. One action is the usual on-off switching function which alternately lights and extinguishes the fluorescent tube. The second action is heating starting elements, such as filaments 102 and 107, prior to firing tube 16.

If desired, two different switches can be incorporated into the circuit to perform the two indicated electrical switching functions, but single switches are known in the art which perform both functions. Also, the construction of switch 79 may be such that it operates either as a rotary or a push-button switch. Switches which can be adapted to provide the dual switching functions are described in these U.S. Pat. Nos.: No. 2,318,057 to Cohen, No. 2,331,040 to Naster, and No. 3,143,605 to Gaynor.

Figure 2:
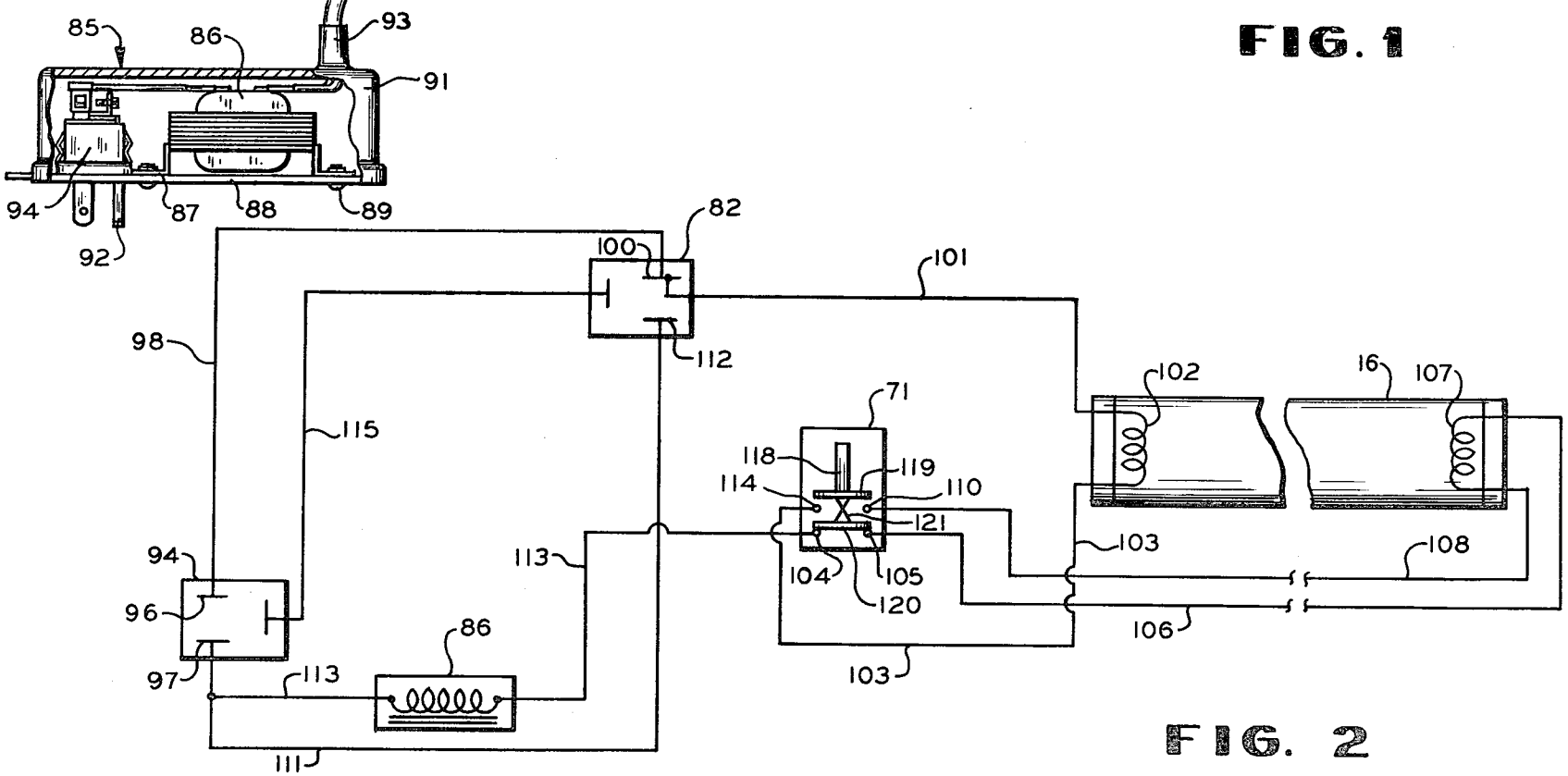
FIG. 2 is a circuit diagram of one circuitry which may be used with the portable fluorescent assembly of FIG. 1.

FIG. 2 illustrates one wiring diagram that may be used and electrically ties together tube 16, switch 79, convenience outlet 82, ballast 86, and electrical plug 94. Plug 94 which is designed to energize the entire apparatus has terminals 96 and 97. Conductor 98 joins terminal 96 to a terminal 100 of convenience outlet 82 which is, in turn, connected in series by conductor 101 to starting filament 102 of fluorescent tube 16 (as through end socket 20) and then by conductor 103 to a circuit terminal 114 of starter switch 79. The companion circuit terminal 110 of the switch is connected by conductor 108 to the other starting filament 107 of the tube (as through end socket 19) and then by conductor 106 to another terminal 105 of switch 79.

The remaining terminal 97 of the plug 94 is connected by conductor 111 to a remaining terminal 112 of convenience outlet 82 and, in parallel, by conductor 113 through ballast 86 to a remaining terminal 104 of switch 79. Convenience outlet 82 may have a common connection 115 to ground for safey reasons.

Switch 79 may be of the type comprising a spring loaded push button represented at 118 which upon depression completes the circuit across circuit terminals 104 and 105 by a plate 120. Push button 118 rotates a plate 120 upon each depression and release so as alternatively to complete a circuit across terminals 104 and 105 upon one depression of the push button and release, and then to rotate plate 120 again so as to break the circuit across terminals 104 and 105 upon the next depression and release. Rotation of plate 120 is by means of a spiral stem 121.

Upon depression of push button 118 of switch 79, plate 119 also completes a circuit across terminals 114 and 110 to heat filaments 102 and 107. Release of push button 118 always breaks this circuit.

At all times, electrical convenience outlet 82 is available for connection to other electrical apparatus and appliances which require a relatively low voltage as compared to that to initiate firing or operating tube 16.

Although the foregoing describes the presently preferred embodiment of the present invention, it is understood that the invention may be practiced in still other forms within the scope of the following claims.

I claim:

1. In a fluorescent tube assembly having starter switch means and an electric convenience outlet associated with the assembly but apart from terminals of such fluorescent tube, electric circuitry therefor comprising conductors adapted to be connected to a source of electrical energy having a predetermined voltage, one of said conductors being connected in series to said convenience outlet and said starter switch means, another of said conductors being connected to said convenience outlet and in parallel through ballast means to said starter switch means, whereby said predetermined voltage is supplied to said convenience outlet associated with the tube assembly, and another and higher voltage is applied to said starter switch means and fluorescent tube for starting the same.

2. A fluorescent tube assembly including a fluorescent tube having end contact pins and starting filament means, an electrical convenience outlet physically located on such assembly but energized other than through said contact pins of the tube, said outlet being adapted to energize other electrical apparatus at one voltage, and a starter switch associated with the assembly for firing the fluorescent tube through said filament means adapted to operate at a second and higher voltage, and circuitry for the assembly including a pair of electrical conductors adapted to be connected to a source of electrical energy supplied at said one voltage, one of said conductors being connected in series with said convenience outlet, said starting filament means and said starter switch, the other of said electrical conductors being connected to said convenience outlet to supply an electric potential thereto at said one voltage directly from said source of electrical energy, and in parallel through ballast means to said starter switch to supply an electric potential thereto at another and higher voltage adapted to fire and operate said fluorescent tube.

3. The fluorescent tube assembly of claim 2 in which said convenience outlet is a female connection.

4. The fluorescent tube assembly of claim 2 in which said convenience outlet is a male connection.

5. The fluorescent tube assembly of claim 2 in which said assembly is portable and includes a handle on the assembly, said handle containing said electrical convenience outlet and said starter switch.

6. The fluorescent tube assembly of claim 2 in which said assembly has a socket construction at one end comprising separable parts adapted to mate and define said socket construction, one of said parts containing said electrical convenience outlet and another of said parts containing said starter switch.

7. The fluorescent tube assembly of claim 2 in which said assembly includes a light-transmitting envelope disposed about said fluorescent tube, socket members at each end of the tube, one of said socket members defining a handle containing said electrical convenience outlet and said starter switch, part of said circuitry extending from socket member to socket member between said fluorescent tube and envelope.

8. A fluorescent tube assembly including a single tube having pin terminals and starting filament means at each end, an electric convenience outlet on the assembly having a pair of terminals energized other than through said pin terminals of the tube adapted to energize still other electrical apparatus at one voltage, and a starter switch having primary circuit terminals adapted to energize the tube after it is fired and secondary circuit terminals adapted to fire the tube through said starting filament means to initiate its lighting, and electric circuitry for the tube comprising:

(a) a pair of conductors adapted to be connected to a source of electric energy supplied at one voltage, (1) one of said conductors being connected, in series, to one of said terminals of the convenience outlet, one of said starting filament means of the tube, through the primary circuit terminals of said starter switch, the other of said starting filament means of the tube, and then to a secondary circuit terminal of the starter switch, (2) the other of said conductors being connected, in parallel, to the other of said terminals of the convenience outlet, through ballast transformer means to the remaining secondary circuit terminal of the starter switch, and to a primary circuit terminal, (b) whereby said one voltage is supplied to said convenience outlet directly from said source of electrical energy, and a second and higher voltage is supplied to said secondary circuit of the starter switch to fire said fluorescent tube.

9. The fluorescent tube assembly of claim 8 in which said assembly is portable, and said starter switch is located on the portable assembly.

10. The fluorescent tube assembly of claim 8 in which said assembly is portable, said starter switch means is located on the portable assembly, and said ballast transformer means is located in said conductor adjacent its free end to relieve the assembly of the weight of the ballast means.

11. The fluorescent tube assembly of claim 8 in which said pair of conductors is combined in an integral electric plug, and said plug and electric convenience outlet have a common ground.

12. A portable fluorescent tube assembly adapted to be connected to a source of electric energy having at the portable assembly itself circuitry providing both a relatively high voltage for firing the tube through starting filaments thereof and a relatively low voltage energized directly from said source of electric energy for electrically energizing other electric apparatus.

* * * * *

UNITED STATES PATENT AND TRADEMARK OFFICE

CERTIFICATE OF CORRECTION

PATENT NO. : 4,287,456

DATED : September 1, 1981

INVENTOR(S) : James W. Kovacik et al.

It is certified that error appears in the above-identified patent and that said Letters Patent is hereby corrected as shown below:

Column 9, line 29, "primary" should read -- secondary --.

Column 9, line 32, "secondary" should read -- primary --.

Signed and Sealed this

*Second* Day of *August 1983*

[SEAL]

*Attest:*

GERALD J. MOSSINGHOFF

*Attesting Officer*

*Commissioner of Patents and Trademarks*